United States Patent [19]

Taylor

[11] 4,151,501

[45] Apr. 24, 1979

[54] TERMINAL MOUNTING MEANS FOR THERMALLY ACTUATED SWITCHES

[76] Inventor: John C. Taylor, 9 Holmfield Park, Ballasalla, near Castletown, Isle of Man

[21] Appl. No.: 792,549

[22] Filed: May 2, 1977

[30] Foreign Application Priority Data

May 7, 1976 [GB] United Kingdom ..... 18897/76

[51] Int. Cl.[2] ..... H01H 61/00

[52] U.S. Cl. ..... 337/89; 337/372

[58] Field of Search ..... 337/89, 365, 367, 368, 337/372

[56] References Cited

U.S. PATENT DOCUMENTS 3,311,725 3/1967 Butler et al. ..... 337/365 X 3,569,888 3/1971 Taylor ..... 337/89

3,872,417 3/1975 Hufschmid ..... 337/365

FOREIGN PATENT DOCUMENTS 903807 8/1962 United Kingdom ..... 337/89

*Primary Examiner*—George Harris

[57] ABSTRACT

An electric switch comprising an insulative body, a pair of electrical terminals mounted on flat portions of one side of the body member, the terminals having ear portions crimped about portions of the body to mount the terminals to the body while providing some resilience in the mounting. One terminal mounts a stationary switch contact and the other terminal mounts a thermally responsive bimetallic snap-acting actuator carrying a movable switch contact.

8 Claims, 2 Drawing Figures

TERMINAL MOUNTING MEANS FOR THERMALLY ACTUATED SWITCHES

The present invention relates to an electric switch including a thermally responsive bimetallic snap-acting switch actuator.

The present invention is particularly concerned with such switches employing actuators of the type comprising a sheet or strip of flexible bimetallic material having a tongue released therefrom between two outer legs, the tongue being connected to the sheet or strip at one end and being free of the sheet or strip at the other end, and the sheet or strip being deformed so as to be movable with changes in temperature between two positions on either side of an intermediate unstable position with a snap-action. Such actuators are described in our U.S. Pat. No. 657,434 and our Patent application Ser. No. 874,012 filed Jan. 31, 1978 and hereinafter will be referred to as being "of the kind described."

The present invention provides an electrical switch including an electrically insulative body member, a pair of electrical terminals mounted on flat portions of one side of the body member, the terminals being secured to the body member by means mechanically engaging with the body member, one of the terminals mounting a stationary electrical contact, and the other terminal mounting an actuator of the kind described, the actuator carrying a movable electrical contact.

Preferably, said actuator is mounted at the free end of the tongue and the movable contact is mounted on the periphery of the actuator, or the contact is mounted at the free end of the tongue and the actuator is mounted on the periphery.

The switch provided in accordance with the invention lends itself to automatic assembly as a result of both terminals (which also serve to mount the switch components) being mounted to flat portions of the body from the same side of the body and engaging mechanically with the body. The securing means could be for example a screw or rivet or as is common a tab or tabs extending through a slot or slots in the body and deformed to secure a terminal. As preferred, for simplicity and to provide some resiliency to resist relaxation of the switch components as a result of heat cycling and/or bending of the terminals which might loosen the terminals from the body, it is preferred to provide ears integral with the terminals and extending laterally therefrom and to crimp such ears around suitably shaped portions of the body member thereby to mount the terminals on the body member.

The terminals are preferably formed from strip metal and are generally flat.

With the switch in accordance with the invention, the actuator may be mounted to a terminal preferably by spot welding, before the terminal is mounted on a body member. This has the advantage that there is no switch contact pressure tending to force the actuator out of engagement with the terminal whilst the mounting operation takes place, in contrast to known arrangements where the actuator is mounted to a terminal positioned in a body member. Since the actuator is mounted at only a single point, this makes for simplicity of assembly and also in use there is little heat loss from the actuator to the terminal, thereby making the actuator more sensitive to self heating and hence to currents flowing therethrough.

Whilst the method of crimping the terminals provides some resiliency of the system, since the body member may preferably be made of a thermo-plastics material which material may not be sufficiently resilient to resist forces arising from bending of the terminals, it is preferable to weaken the terminals adjacent where the terminals extend from the insulative body to make electrical connection with an external circuit such as by providing an aperture in the terminals whereby if the terminals are bent the terminals tend to bend at the weakened portion and stresses are not transmitted to the crimps.

As a result of mounting the two terminals on one side of the body with the actuator mounted at a single point with a switch contact on the periphery or on the central tongue of the actuator, it is possible to provide a thin body and hence a thin overall switch whilst still providing sufficient creepage and clearance distances between the actuator and adjacent parts of the switch having opposite polarity to allow the switch to be used and approved by National Approval Authorities for use in dirty conditions.

A preferred embodiment of the invention will now be described with reference to the accompanying drawings wherein.

Figure 1:
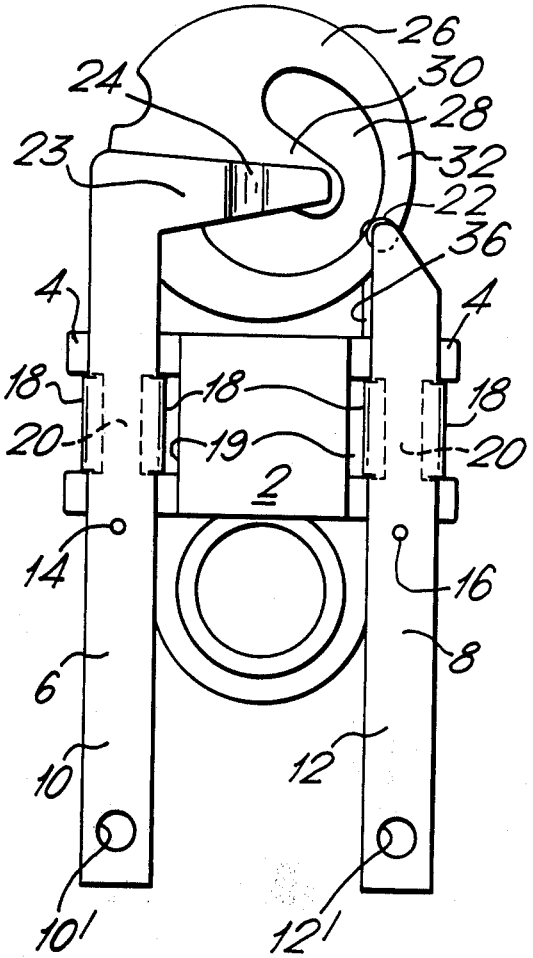
FIG. 1 is a plan view of an electric switch according to the invention.
Figure 2:
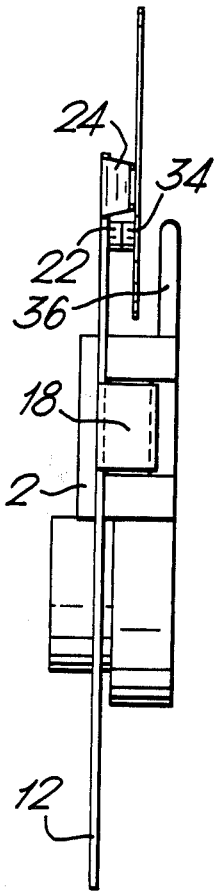
FIG. 2 is a side view of a switch according to the invention.

Referring to the drawings, an electrically insulative thermo-plastics fibre reinforced body 2 rectangular in shape and thin in relation to its other dimensions has two flat portions 4 on one side of the body lying in a common plane on which electrical terminals 6, 8 are positioned. Terminals 6, 8 are formed from strips of brass and ends 10, 12 of the terminals extend from one end of the body and have apertures 10', 12' so that wires may be soldered therein for making electrical connection to an external circuit. Terminals 6, 8 have adjacent the one end of the body small apertures 14, 16 which serve to weaken the terminals in these regions so that bending forces on the terminals arising when the switch is fixed in an external circuit are not transmitted to means securing the terminals to the body, but instead the terminals tend to bend about the weakened regions.

The terminals 6, 8 each have two lateral ear portions 18 extending in opposite directions. Flat body portions 4 have slots 19 extending through to the other side of the body and defining therebetween bar portions 20. In assembly ears 18 are crimped around to encircle bar portions 20 thereby to secure terminals 6, 8 to the body 2. Such crimping provides resilience in the securing of the terminals. An end of terminal 8 mounts a stationary electrical contact 22. The other terminal 10 has an L-shaped end portion 23 with the free end being stepped at 24 and mounting at the free end a bi-metallic thermally responsive snap-acting switch actuator 26. Actuator 26 is of the type disclosed in our co-pending U.S. Pat. application Ser. No. 874,012 filed Jan. 31, 1978, and comprises a member of sheet bimetal having a generally U-shaped aperture 28 therein defining a tongue 30 free at one end, a peripheral area 32 surrounding said tongue and in relation to which the tongue 30, is centrally disposed having been deformed in a die pressing operation to conform in shape to a die of domed configuration, the domed area being such as to reverse its curvature with a snap action with change in temperature.

The free end of the tongue is spot welded to the end of terminal 10. A movable switch contact 34 is mounted on the periphery 32 of the actuator 28 at a point opposite the free end of the tongue so that under normal conditions the movable contact is in contact with the stationary contact 22.

An integral portion 36 of body 2 extends generally coextensively with the contact carrying end of terminal 8 but on the other side of body 2 and serves as a back stop for actuator 26.

A thin plastics cover is normally provided secured to one end of the body to cover the switch components.

In use of the switch the actuator may be exposed to heat from, for example, an air flow so that when the temperature of the air flow rises above a desired temperature the actuator 26 snap acts to an inverted configuration in which movable contact 34 is disengaged from stationary contact 22, thereby opening the switch Alternatively the switch may be used as a current sensitive circuit breaker in which electric current passing through actuator 26 self-heats the actuator above its operating temperature when excess current is present, thereby to disengage contact 34 from contact 22.

In the assembly of the above described switch, stationary contact 22 and actuator 26 are welded to their respective terminals 8, 6 prior to mounting the terminals on the body 2. For the actuator, this has the advantage that there is no switch contact pressure tending to force the actuator out of engagement with the terminal during the welding operation. The terminals can be crimped automatically in a single operation onto the flat portions 4 of the body, which lie in a common plane, with suitable apparatus. A particular advantage in employing crimping to secure the terminals to the body is that there is provided some resiliency in the securing and any relaxation in the thermo-plastics body arising from heat cycling of the switch during use is taken up by the resiliency of the securing means.

For sensing radiant heat, there is a large area of the bi-metallic actuator exposed to incoming radiation. In the construction shown, only the small backstop 36 shields incoming radiation from the actuator. The sensitivity of the actuator is also helped by the small heat conductive capacity of the single weld point terminal: thus the switch has a fast response time to a change in conditions.

With both terminals on the same side of the bi-metallic actuator and the contact on the periphery of the actuator, there is provided, despite the thinness of the body 2 and hence the overall switch, adequate creepage and clearance distances between the actuator and adjacent parts of the switch having opposite polarity to allow the switch to be used and approved by National Approval Authorities for use in dirty conditions.

The temperature of the assembled switch may be checked automatically and if the operating temperature is higher than that desired, the operating temperature can be adjusted by increasing the switch contact pressure by deforming portion 23 of terminal 10, thereby to lower the operating temperature of the actuator.

What is claimed is:

1. An electrical switch comprising an electrically insulative body member including flat portions on one side thereof, a pair of electrical terminals each having a pair of ears extending from one side of the terminals and integral with the terminals, said ears being crimped about the portions of the body member to resiliently secure the terminals to the body member, one of the terminals providing a stationary contact, the other terminal having an actuator mounted thereon, the actuator comprising a member of flexible bimetallic material having a tongue free at one end, the tongue being integral with and surrounded by a peripheral portion, the actuator being deformed to provide for movement of the actuator in response to changes in temperature, the actuator providing a movable electrical contact which makes electrical connection with the stationary contact.

2. A switch as claimed in claim 1 wherein said actuator is mounted at the free end of the tongue and the movable contact is mounted on the periphery of the actuator.

3. A switch as claimed in claim 2 wherein, in the assembly of the switch, the actuator is mounted to the terminal before the terminal is mounted on the body member.

4. A switch as claimed in claim 1 wherein the terminals are formed from strip metal.

5. A switch as claimed in claim 1 wherein the terminals are weakened adjacent where the terminals extend from the body member to make connection with an external electrical circuit.

6. A switch as claimed in claim 1 wherein the ears include tips which are bent inwardly with respect to each other to provide for engagement of the body member by the terminals.

7. An electrical switch according to claim 6 wherein the terminals have a generally flat shape and the terminals extend in generally parallel relation to one another.

8. An electrical switch according to claim 7 wherein the body member includes two spaced apart flat body portions and each flat body portion includes a slot, the terminals being mounted to the flat body portions to provide for protrusion of one ear from each terminal through the slots, the tips of the ears being bent to resiliently engage the body member.

* * * * *